US010689229B2

(12) United States Patent
Fonteneau et al.

(10) Patent No.: US 10,689,229 B2
(45) Date of Patent: Jun. 23, 2020

(54) ELEVATOR SYSTEM SUSPENSION MEMBER TERMINATION

(71) Applicant: Otis Elevator Company, Farmington, CT (US)

(72) Inventors: Nicolas Fonteneau, Chateauneuf sur Loire (FR); Frédéric Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 240 days.

(21) Appl. No.: 15/562,280

(22) PCT Filed: Mar. 27, 2015

(86) PCT No.: PCT/IB2015/000549
§ 371 (c)(1),
(2) Date: Sep. 27, 2017

(87) PCT Pub. No.: WO2016/156901
PCT Pub. Date: Oct. 6, 2016

(65) Prior Publication Data

US 2018/0079625 A1 Mar. 22, 2018

(51) Int. Cl.
*B66B 7/08* (2006.01)
*B66B 11/00* (2006.01)
*B66B 11/04* (2006.01)

(52) U.S. Cl.
CPC ..... *B66B 7/085* (2013.01); *B66B 7/08* (2013.01); *B66B 11/0035* (2013.01); *B66B 11/043* (2013.01)

(58) Field of Classification Search
CPC ..... B66B 7/08; B66B 7/085; B66B 19/007; B66B 11/0035; B66B 11/004; B66B 11/0045
See application file for complete search history.

(56) References Cited

U.S. PATENT DOCUMENTS 4,537,286 A 8/1985 Morris et al.
6,234,276 B1 5/2001 Wagatsuma et al.
(Continued)

FOREIGN PATENT DOCUMENTS

CN 102556810 A 7/2012
CN 203699603 U 7/2014
(Continued)

OTHER PUBLICATIONS

European Search Report Issued in EP Application No. 15741306.3, dated Feb. 2, 2019, 5 Pages.
(Continued)

*Primary Examiner* — Minh Truong
(74) *Attorney, Agent, or Firm* — Cantor Colburn LLP

(57) ABSTRACT

An elevator system includes a hoistway and an elevator car suspended in the hoistway via one or more suspension members. A counterweight is suspended in the hoistway via the one or more suspension members to balance operation of the elevator car. A machine is positioned at the hoistway to drive the one or more suspension members along the hoistway, driving motion of the elevator car and/or counterweight along the hoistway. A suspension member termination is supported at the machine, to secure an end of the one or more suspension members. A drive system for an elevator includes one or more elevator suspension members and a machine interactive with the one or more elevator suspension members to drive motion of an elevator car. A suspension member termination is supported at the machine to secure an end of the one or more suspension members at the machine.

8 Claims, 5 Drawing Sheets

(56) References Cited

U.S. PATENT DOCUMENTS

| | | | | |
|---|---|---|---|---|
| 6,446,762 | B1 | 9/2002 | St. Pierre et al. | |
| 7,150,342 | B2 | 12/2006 | Adifon et al. | |
| 7,543,685 | B2 | 6/2009 | Ach et al. | |
| 7,624,847 | B2 * | 12/2009 | Liebetrau | B66B 19/007 187/266 |
| 8,302,740 | B2 | 11/2012 | Swaybill et al. | |
| 8,793,939 | B2 | 8/2014 | Landry et al. | |
| 8,820,483 | B2 | 9/2014 | Ericson et al. | |
| 2006/0042882 | A1 * | 3/2006 | Swaybill | B66B 7/08 187/254 |
| 2006/0266592 | A1 | 11/2006 | Monzon et al. | |
| 2007/0017751 | A1 | 1/2007 | Liebetrau et al. | |
| 2008/0185232 | A1 * | 8/2008 | Henneau | B66B 5/00 187/277 |
| 2010/0084224 | A1 | 4/2010 | Hao | |
| 2011/0101198 | A1 | 5/2011 | Trach | |
| 2017/0225926 | A1 * | 8/2017 | Watanabe | B66B 11/043 |

FOREIGN PATENT DOCUMENTS

| | | | |
|---|---|---|---|
| CN | 204022198 | U | 12/2014 |
| CN | 204185063 | U | 3/2015 |
| EP | 1597182 | A1 | 11/2005 |
| JP | 5954476 | U | 4/1984 |
| JP | 2001220078 | A | 8/2001 |
| JP | 2002087741 | A | 3/2002 |
| WO | 2004069715 | A1 | 8/2004 |
| WO | 2012108872 | A1 | 8/2012 |
| WO | 2013076790 | A1 | 5/2013 |
| WO | 2014070208 | A1 | 5/2014 |

OTHER PUBLICATIONS

International Search Report for International Application No. PCT/IB2015/000549; International Filing Date Mar. 27, 2015; dated Oct. 27, 2015, 5 pages.

Written Opinion for International Application No. PCT/IB2015/000549; International Filing Date Mar. 27, 2015; dated Oct. 27, 2015, 6 pages.

Chinese Office Action Isssued in CN Application No. 201580078313.1, dated Nov. 9, 2018, 8 Pages.

* cited by examiner

ELEVATOR SYSTEM SUSPENSION MEMBER TERMINATION

CROSS REFERENCE TO RELATED APPLICATIONS

This application is a National Stage application of PCT/IB2015/000549, filed Mar. 27, 2015, the entire contents of which are hereby incorporated by reference.

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt, that moves along a hoistway. The tension member is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member, with a counterweight end of the suspension member terminated, or retained in the hoistway. Often, this termination is at a machine bedplate, a structural member extending across the hoistway.

Building customers are seeking to reduce hoistway dimensions for elevator systems as much as possible, while retaining a practical elevator system. Hoistway dimensions are most often driven by, or dictated by, landing door frame width, machine width plus counterweight width, or a combination of machine dimensions and counterweight termination position. Recent improvements in doorframe technology allowing for reduced width doorframes has enabled narrower hoistways.

BRIEF SUMMARY

In one embodiment, an elevator system includes a hoistway and an elevator car suspended in the hoistway via one or more suspension members. A counterweight is suspended in the hoistway via the one or more suspension members to balance operation of the elevator car. A machine is positioned at the hoistway to drive the one or more suspension members along the hoistway, driving motion of the elevator car and/or counterweight along the hoistway. A suspension member termination is supported at the machine, to secure an end of the one or more suspension members.

Additionally or alternatively, in this or other embodiments the machine is supportive of a counterweight end of the one or more suspension members, the counterweight end nearest the counterweight.

Additionally or alternatively, in this or other embodiments the suspension member termination is supported by a machine frame.

Additionally or alternatively, in this or other embodiments a termination opening is located in the machine frame. The suspension member termination extends through the termination opening.

Additionally or alternatively, in this or other embodiments a termination body is formed integral to the machine.

Additionally or alternatively, in this or other embodiments a termination wedge is inserted into the termination body to secure the one or more suspension members at the termination body.

Additionally or alternatively, in this or other embodiments the machine is positioned at a machine bedplate in the hoistway.

Additionally or alternatively, in this or other embodiments the elevator car is located adjacent to the counterweight relative to a width of the hoistway.

In another embodiment, a drive system for an elevator includes one or more elevator suspension members and a machine interactive with the one or more elevator suspension members to drive motion of an elevator car. A suspension member termination is supported at the machine to secure an end of the one or more suspension members at the machine.

Additionally or alternatively, in this or other embodiments the suspension member termination is supported by a machine frame.

Additionally or alternatively, in this or other embodiments a termination opening is positioned in the machine frame. The suspension member termination extends through the termination opening.

Additionally or alternatively, in this or other embodiments a termination body is formed integral to the machine.

Additionally or alternatively, in this or other embodiments a termination wedge is inserted into the termination body to secure the one or more suspension members at the termination body.

Additionally or alternatively, in this or other embodiments the machine is positioned at a machine bedplate in the hoistway.

Additionally or alternatively, in this or other embodiments the machine is supportive of a counterweight end of the one or more suspension members. The counterweight end is nearest a counterweight of the elevator.

Additionally or alternatively, in this or other embodiments an elevator car is disposed in a hoistway adjacent to the counterweight relative to a width of the hoistway.

The detailed description explains the invention, together with advantages and features, by way of examples with reference to the drawings.

DETAILED DESCRIPTION

Figure 1:
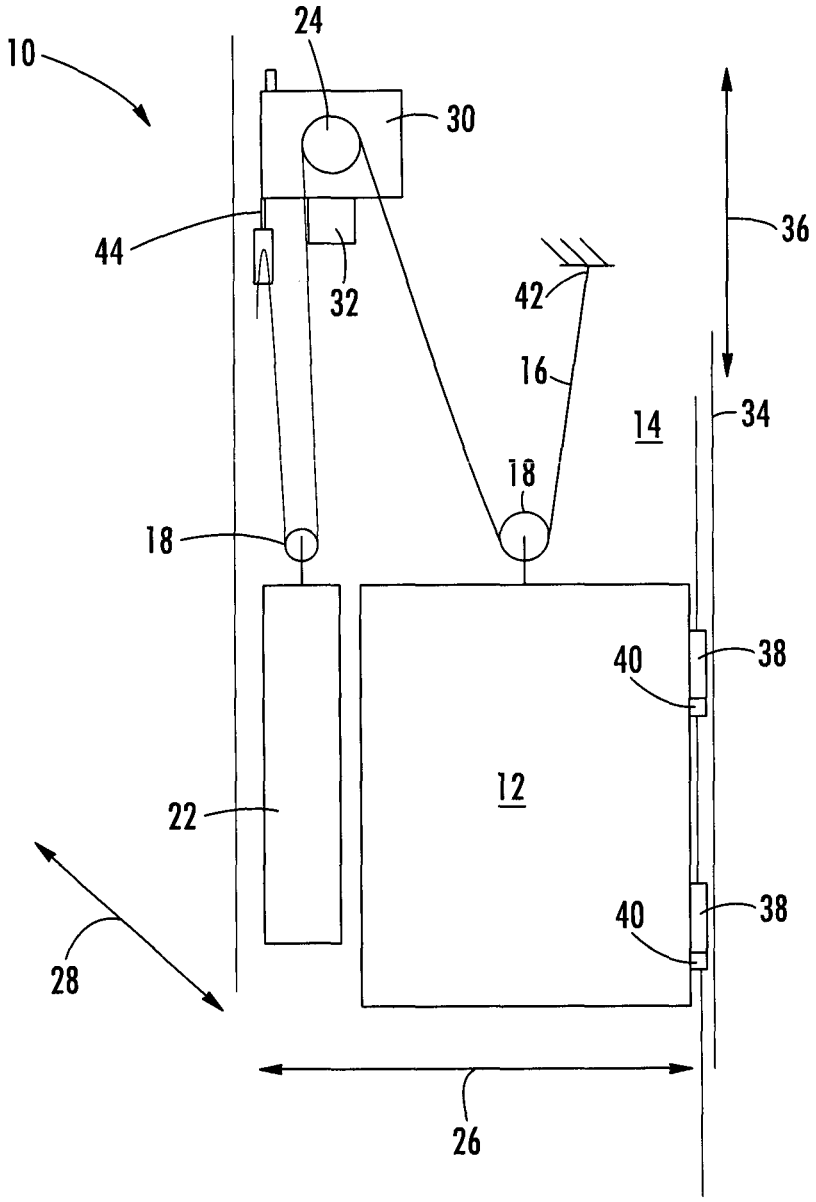
FIG. 1 is a schematic view of an exemplary elevator system.

Shown in FIG. 1 is a schematic illustration of an exemplary elevator system 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more suspension members 16 are connected to a counterweight 22, which is used to help balance the elevator system 10 and reduce the difference in belt tension on both sides of a traction sheave 24 during operation. The hoistway 14 has a width 26 and a depth 28, and in some embodiments the counterweight 22 and elevator car 12 are positioned adjacently across the width 26 of the hoistway 14.

The sheaves 18 each have a diameter 20, which may be the same or different than the diameters of the other sheaves 18 in the elevator system 10. At least one of the sheaves is a traction sheave 24 driven by a machine 30. The machine 30 is disposed at and supported by a machine bedplate 32 extending across the hoistway 14 depth 28. Movement of traction sheave 24 by the machine 30 drives, moves and/or propels (through traction) the one or more suspension members 16 that are routed around the traction sheave 24. At least one of the sheaves 18 could be a diverter, deflector or idler sheave. Diverter, deflector or idler sheaves are not driven by the machine 30, but help guide the one or more suspension members 16 around the various components of the elevator system 10.

The elevator system 10 further includes one or more guide rails 34 to guide the elevator car 12 along a vertical length 36 of the hoistway 14. The elevator car 12 further includes one or more guide shoes 38 interactive with the guide rails 34 to guide the elevator car 12, and also may include safeties 40 interactive with the guide rail 34 to slow and/or stop motion of the elevator car 12 under certain conditions, such as an overspeed condition.

While the elevator system 10 shown is a 2:1 roping arrangement, it is to be appreciated that elevator systems 10 with other roping arrangements, for example, 3:1 roping arrangements, are contemplated within the scope of the present disclosure. In the embodiment of FIG. 1, the suspension members 16 terminate in the hoistway 14 at a car end termination 42 nearest the elevator car 12 and at a counterweight end termination 44 nearest the counterweight 22.

Figure 2:
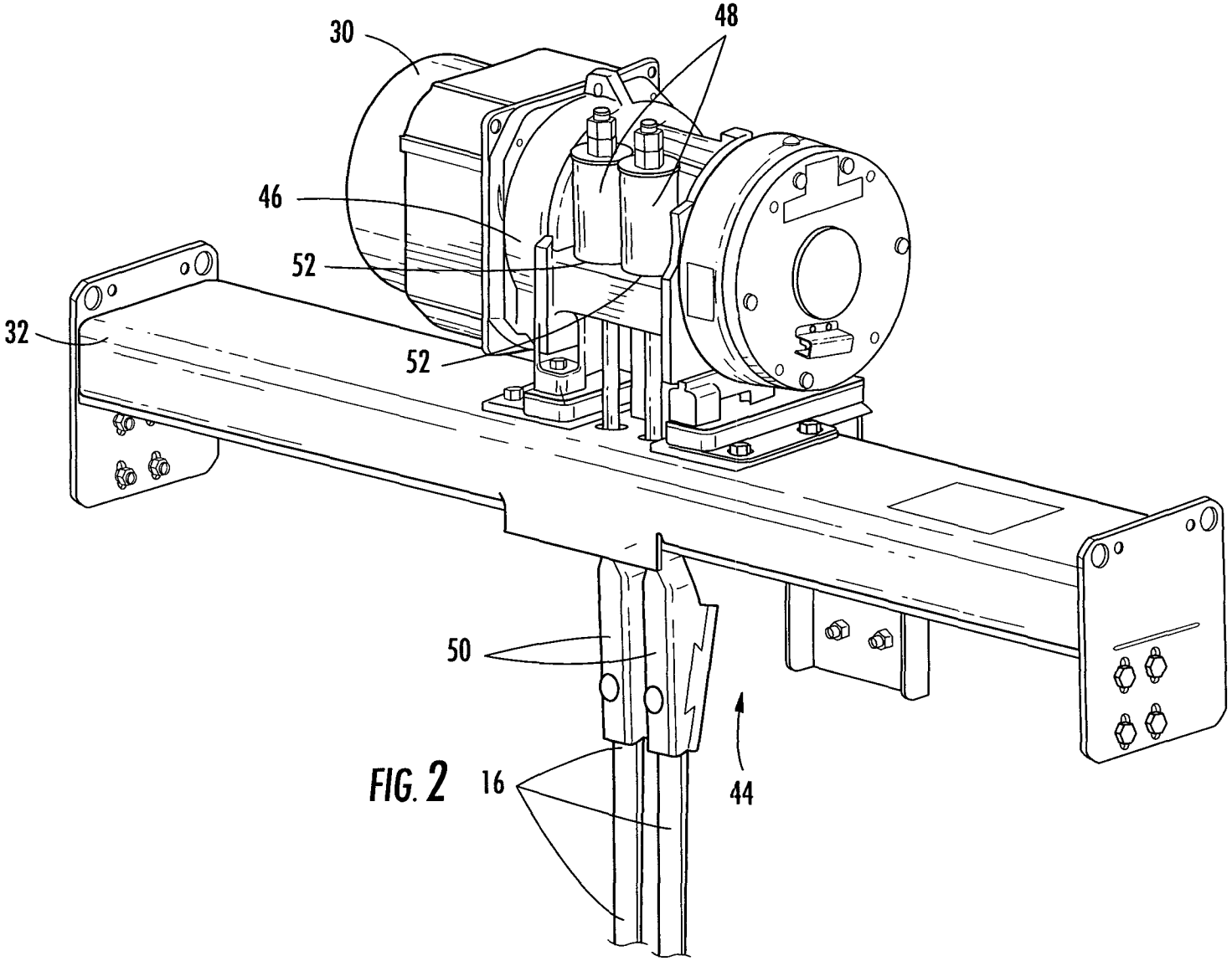
FIG. 2 is a perspective view of an embodiment of a machine and suspension member termination for an elevator system.
Figure 3:
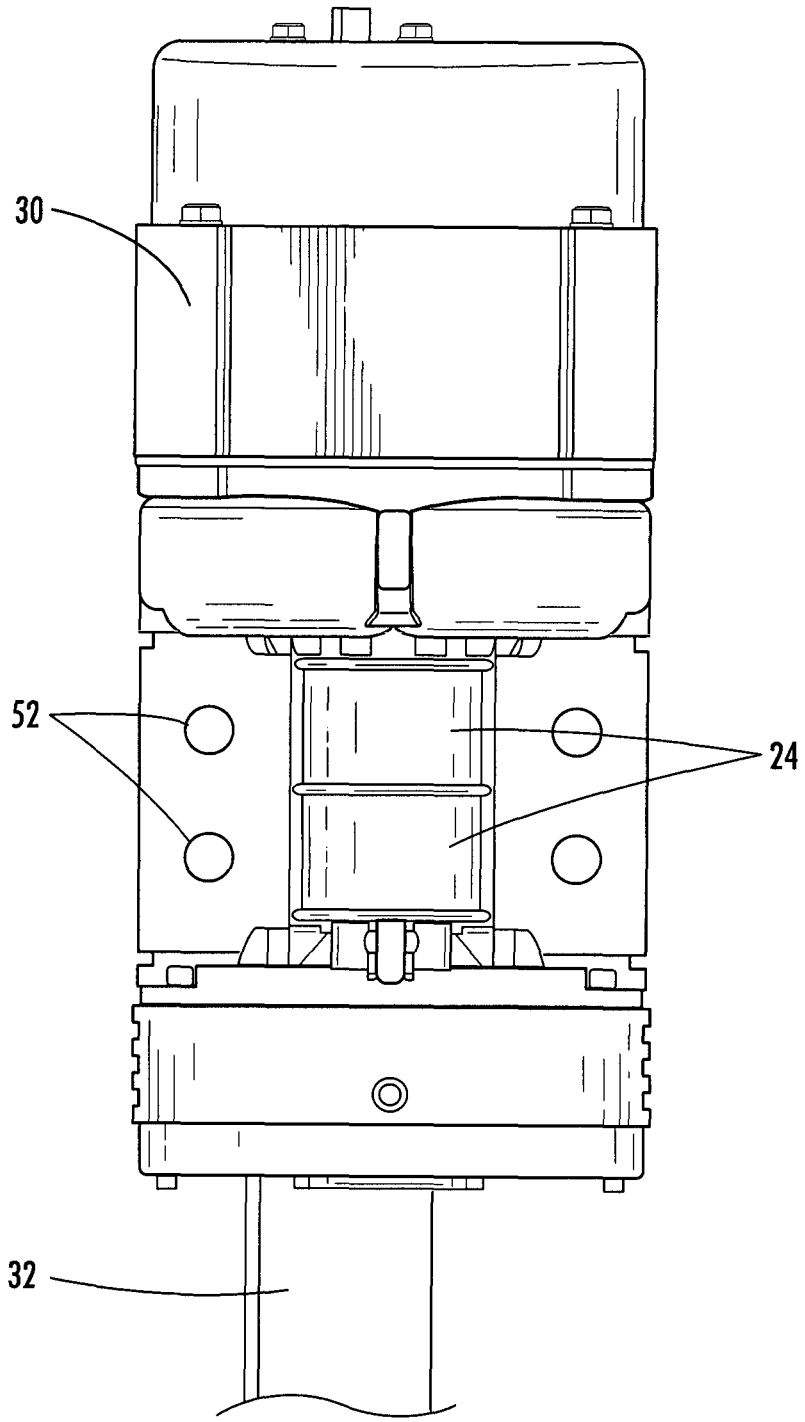
FIG. 3 is a plan view of an embodiment of a machine and suspension member termination for an elevator system.

Referring now to FIGS. 2 and 3, the counterweight end termination 44 is supported by a machine frame 46 of the machine 30. The machine frame 46 is typically formed from a metal material and is either cast or machined or a combination of the two. A hitch 48 of the counterweight end termination 44 extends from a termination body 50, where the suspension member 16 is retained, and through a machine frame opening 52 where the hitch 48 is retained. Supporting the counterweight end termination 44 directly at the machine frame 46 places the termination 44 closer to the machine 30 relative to the hoistway width 26, thus allowing for the hoistway width 26 to be reduced. Further, utilizing the machine frame 46 to support the termination 44 eliminates the need for additional parts such as brackets, etc., typically utilized to retain the termination at the machine bedplate 32 or a separate termination bedplate.

Figure 4:
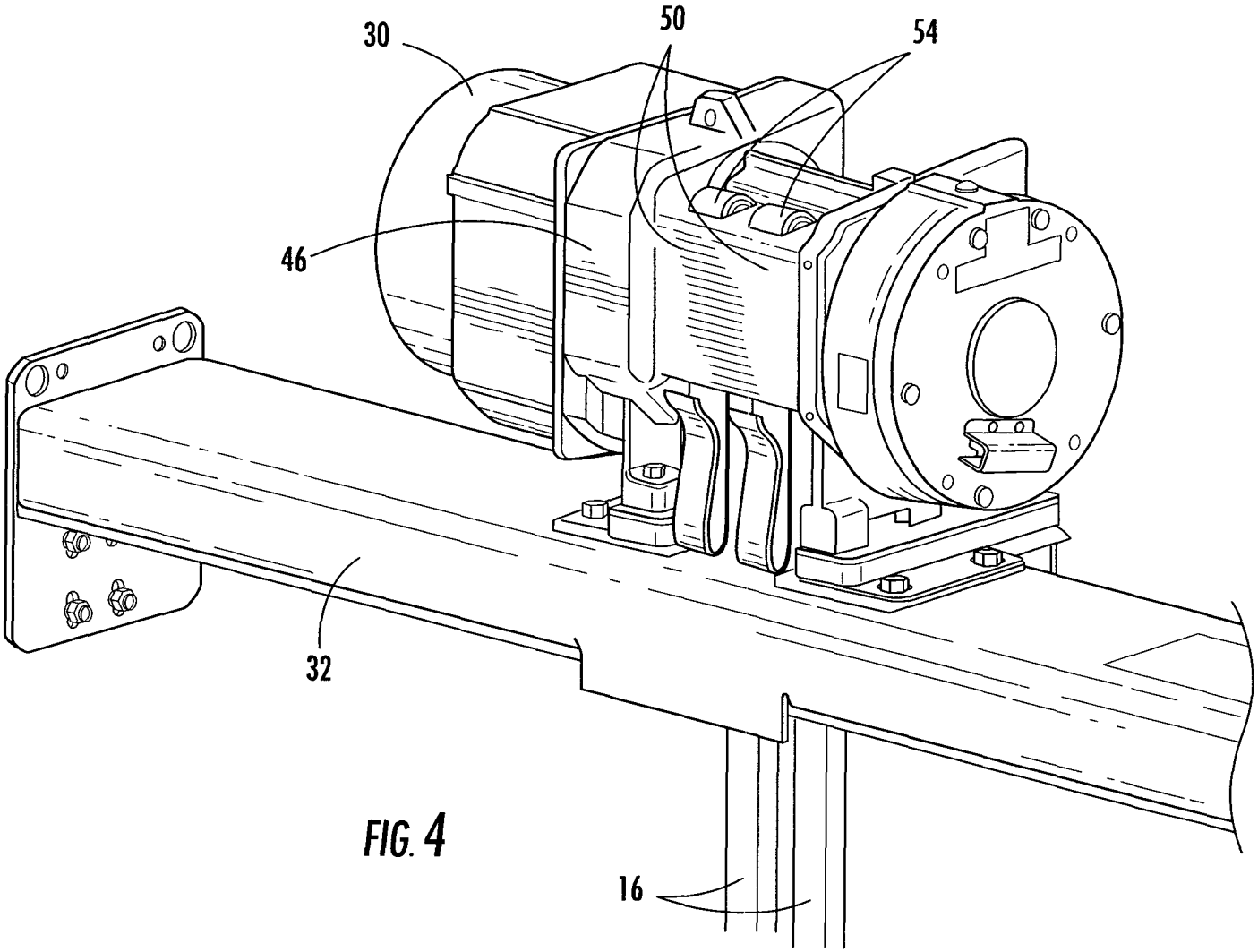
FIG. 4 is a perspective view of another embodiment of a machine and suspension member termination for an elevator system.
Figure 6:
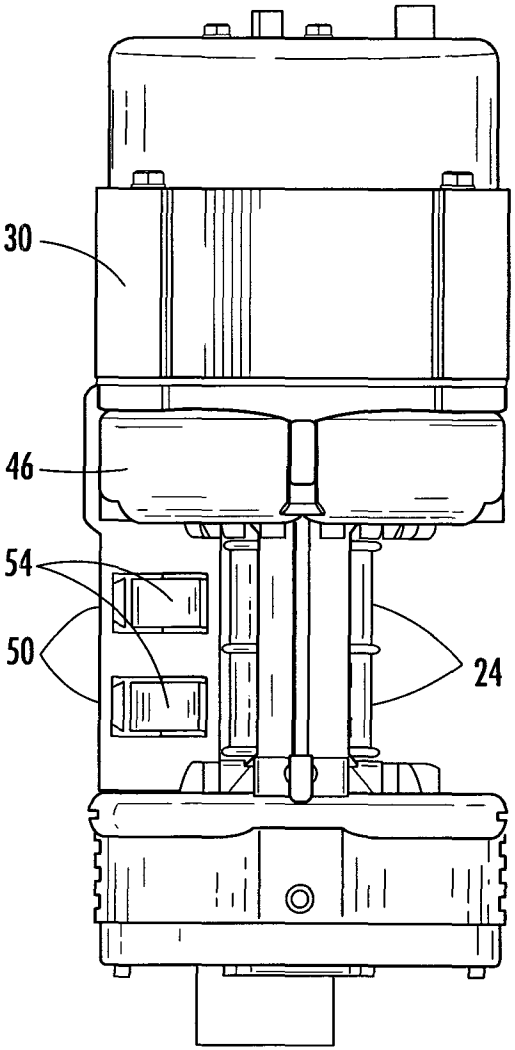
FIG. 6 is a plan view of another embodiment of a machine and suspension member termination for an elevator system.
Figure 5:
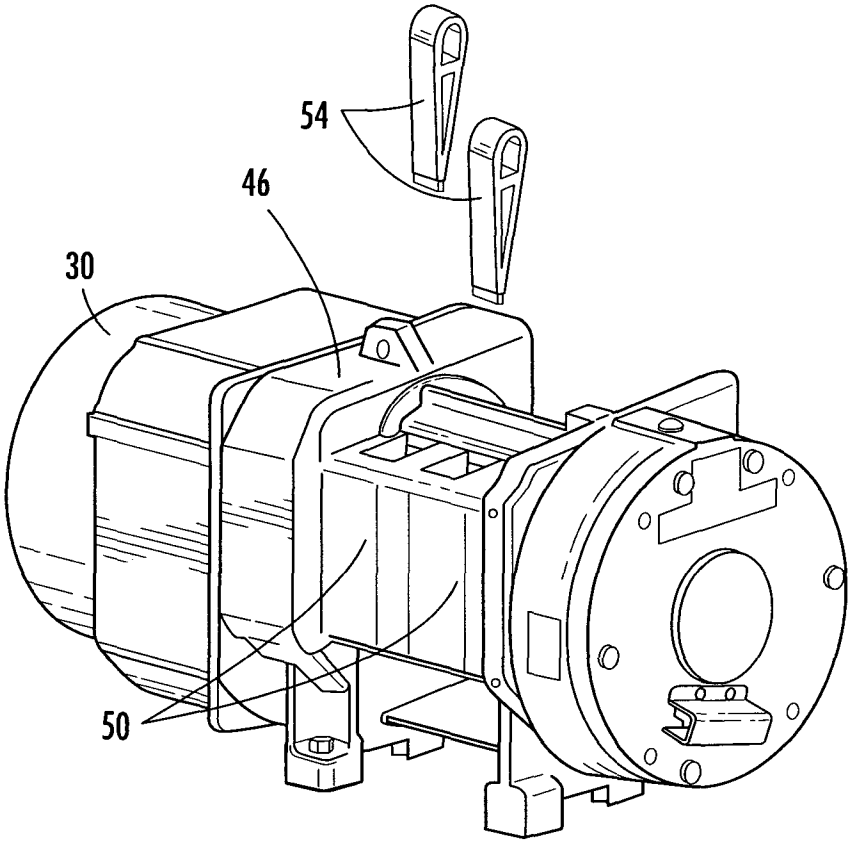
FIG. 5 is another perspective view of another embodiment of a machine and suspension member termination for an elevator system.

Referring to FIGS. 4-6, in an alternative embodiment, the counterweight end termination 44 is integral to the machine frame 46. The termination body 50 is formed as part of the machine frame 46 and termination wedges 54 are installed into the termination body 50 to retain the suspension members 16 at the counterweight end termination 44. Incorporating the termination body 50 into the machine frame 46 eliminates the additional termination body part, and as with the embodiments of FIGS. 2 and 3, places the termination 44 closer to the machine 30 relative to the hoistway width 26, thus allowing for the hoistway width 26 to be reduced. Further, utilizing the machine frame 46 to support the termination 44 eliminates the need for additional parts such as brackets, etc., typically utilized to retain the termination at the machine bedplate 32 or a separate termination bedplate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system comprising:

a hoistway;

an elevator car suspended in the hoistway via one or more suspension members;

a counterweight suspended in the hoistway via the one or more suspension members to balance operation of the elevator car;

a bedplate extending across the hoistway;

a machine disposed at the bedplate to drive the one or more suspension members along the hoistway, driving motion of the elevator car and/or counterweight along the hoistway, the machine including a machine frame secured to the bedplate;

a suspension member termination disposed at the machine frame, to secure an end of the one or more suspension members; wherein a termination body is formed integral to the machine frame, and a termination wedge inserted into the termination body to secure the one or more suspension members at the termination body.

2. The elevator system of claim 1, wherein the machine is supportive of a counterweight end of the one or more suspension members, the counterweight end nearest the counterweight.

3. The elevator system of claim 1, further comprising a termination opening in the machine frame, the suspension member termination extending through the termination opening.

4. The elevator system claim 1, wherein the elevator car is disposed adjacent to the counterweight relative to a width of the hoistway.

5. A drive system for an elevator comprising:

one or more elevator suspension members;

a machine interactive with the one or more elevator suspension members to drive motion of an elevator car, the machine including a machine frame configured to be secured to bedplate;

a suspension member termination disposed at the machine frame, to secure an end of the one or more suspension members at the machine; wherein a termination body is formed integral to the machine frame, and a termination wedge inserted into the termination body to secure the one or more suspension members at the termination body.

6. The drive system of claim 5, further comprising a termination opening in the machine frame, the suspension member termination extending through the termination opening.

7. The drive system of claim 5, wherein the machine is supportive of a counterweight end of the one or more suspension members, the counterweight end nearest a counterweight of the elevator.

8. The drive system of claim 7, wherein an elevator car is disposed in a hoistway adjacent to the counterweight relative to a width of the hoistway.

* * * * *